US007547271B2

(12) United States Patent
Kato

(10) Patent No.: US 7,547,271 B2
(45) Date of Patent: Jun. 16, 2009

(54) FILTER ROD MAKING MACHINE

(75) Inventor: Katsuo Kato, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 374 days.

(21) Appl. No.: 11/482,807

(22) Filed: Jul. 10, 2006

(65) Prior Publication Data

US 2006/0252622 A1 Nov. 9, 2006

Related U.S. Application Data

(63) Continuation of application No. PCT/JP2005/002476, filed on Feb. 17, 2005.

(30) Foreign Application Priority Data

Mar. 16, 2004 (JP) ..... 2004-074412

(51) Int. Cl.
*B31C 99/00* (2009.01)

(52) U.S. Cl. ..... 493/42; 493/4; 493/40; 493/45; 493/50; 53/584

(58) Field of Classification Search ..... 493/4, 493/40, 42, 44–50, 941; 53/444, 584
See application file for complete search history.

(56) References Cited

U.S. PATENT DOCUMENTS 3,390,039 A * 6/1968 Caughman et al. ..... 156/166
3,533,416 A 10/1970 Berger et al.
3,837,264 A * 9/1974 Sexstone ..... 493/42
3,844,200 A * 10/1974 Sexstone ..... 493/45
3,943,832 A * 3/1976 Sexstone ..... 493/42
4,075,936 A * 2/1978 Berger ..... 493/43
4,109,666 A * 8/1978 Norman et al. ..... 131/339
4,525,161 A * 6/1985 Luke ..... 493/42
5,316,827 A * 5/1994 Hill et al. ..... 428/175
6,908,421 B2 * 6/2005 Koborinai et al. ..... 493/39
7,261,681 B2 * 8/2007 Pehmoller et al. ..... 493/49

FOREIGN PATENT DOCUMENTS

| | | |
|---|---|---|
| GB | 311832 | 12/1927 |
| GB | 798118 | 7/1958 |
| JP | 6-327455 A | 11/1994 |
| JP | 7-203935 A | 8/1995 |
| JP | 9-294577 A | 11/1997 |
| JP | 2003-111584 A | 4/2003 |
| SU | 383243 | 5/1973 |

* cited by examiner

*Primary Examiner*—Hemant M Desai
(74) *Attorney, Agent, or Firm*—Birch, Stewart, Kolasch & Birch, LLP

(57) ABSTRACT

A filter rod making machine comprises a tow treatment section (10) for forming a filter web ($W_F$) from fibrous tow (T), a scatter device (42) for scattering activated carbon grains ($P_C$) evenly over the filter web ($W_F$) fed from the tow treatment section (10) toward a trumpet guide (34), the trumpet guide (34) forming the filter web into a rod-shaped material ($W_R$), a web guide (36) arranged between the tow treatment section (10) and the trumpet guide (34) for supporting the lower surface of the filter web ($W_F$) and guiding the filter web ($W_F$) while it is transported, and a wrapping section (16) for wrapping the rod-shaped material ($W_R$) fed from the trumpet guide (34) in a paper web.

8 Claims, 5 Drawing Sheets

FILTER ROD MAKING MACHINE

This application is a Continuation of copending PCT International Application No. PCT/JP2005/002476 filed on Feb. 17, 2005, which designated the United States, and on which priority is claimed under 35 U.S.C. § 120. This application also claims priority under 35 U.S.C. § 119(a) on Patent Application No(s). 2004-074412 filed in Japan on Mar. 16, 2004. The entire contents of each of the above documents is hereby incorporated by reference.

TECHNICAL FIELD

This invention relates to a machine for making filter rods containing a granular additive.

BACKGROUND ART

A filter rod of this type includes a cylindrical filter material and paper wrapping the filter material. The filter material is formed, for example by a machine disclosed in Japanese Unexamined Patent Publication No. Hei 7-203935.

Specifically, the machine disclosed in the above publication comprises a tow treatment section for forming a flat sheet-like filter web from fibrous tow, and a forming section for receiving the filter web from the tow treatment section and gathering up the received filter web to form it into a rod-shaped material.

The rod-shaped material is then fed from the forming section to a wrapping section. While passing through the wrapping section, the rod-shaped material is wrapped in a paper web and formed into a filter rod continuum. The filter rod continuum is cut into individual filter rods.

The filter rods thus formed are, for example, cut to a predetermined length and used as filter tips for cigarettes. When a filter cigarette is smoked, the filter tip captures nicotine and tar contained in mainstream smoke of the filter cigarette and serves to lighten the feeling that the filter cigarette gives when smoked.

When the filter tip contains a granular additive, for example activated carbon grains, the activated carbon grains absorb undesired substances contained in mainstream smoke and serves to improve the taste of a filter cigarette.

The filter tip containing such additive grains is called a dual filter tip. The dual filter tip comprises a plain half-tip and a functional half-tip. The plain half-tip is obtained by cutting the above-mentioned plain filter rod, while the functional half-tip is obtained by cutting a functional filter rod containing additive grains.

In order to obtain such a functional filter rod, it is conceivable to arrange an additive scattering device above between the tow treatment section and the forming section, and scatter additive evenly over the filter web from the scattering device.

However, in this arrangement, the filter web is completely free on a transport path thereof from the terminal end of the tow treatment section to the forming section. Due to the weight of the filter web and the weight of the additive scattered over the web, the filter web bends downward in its widthwise central part, and is deformed to an arched transverse cross-section. Further, while travelling, the filter web oscillates vertically.

This deformation and oscillation of the filter web makes the additive scattered over the filter web move to the bottom of the arched filter web, so that the additive is not evenly distributed over the filter web. When a functional filter rod is formed from the filter web with the additive unevenly distributed, the functional filter rod or functional half-tips obtained therefrom do not show uniform additive-distribution-density in the cross-section thereof so that the additive is evenly distributed in the functional half-tips.

In this case, if the additive grains are activated carbon grains, the activated carbon grains are not well exposed to mainstream smoke, and the grains cannot effectively absorb substances contained in the mainstream smoke. As a result, the absorption performance of the dual filter tip lowers.

When the functional half-tip is formed by cutting the functional filter rod, uneven distribution of additive grains increases the amount of the additive grains falling off a cut face of the functional filter rod or the half-tip. Further, if additive grains are located near a lap seam of the paper web in a concentrated manner, additive grains easily enter the lap seam and causes defective wrapping of the paper web. The defective wrapping of the paper web causes a shutdown of a functional-filter-rod making machine and lowers productivity in making the functional filter rods.

In order to improve the performance of the functional half-tip, it is conceivable to increase the amount of additive grains added. However, this further increases the incidence of the above problems, namely additive grains falling and defective wrapping of the paper web.

A machine similar to that described is known. The known machine comprises a guide arranged between the tow treatment section and the forming section to guide the filter web while the web is gathered up. The guide is in the form of a trough having a U-shaped cross-section or a coil tunnel, for example.

However, the guide in either form is not effective in preventing the granular additive from moving on the filter web.

SUMMARY OF THE INVENTION

An object of the invention is to provide a filter rod making machine capable of distributing a granular additive evenly in a filter rod, only by adding a simple mechanism.

In order to achieve the above object, a filter rod making machine according to this invention comprises a tow treatment section for forming a flat filter web from fibrous tow, the tow treatment section including an outlet through which the formed filter web is fed; a forming section for forming the filer web into a rod-shaped material, the forming section including a trumpet guide through which the filter web fed from the tow treatment section is passed so that the filter web is gathered up into the rod-shaped material; a wrapping section for wrapping the rod-shaped material in a paper web to form a filter rod continuum, the wrapping section having an inlet for receiving the rod-shaped material from the forming section; and a scatter section for scattering a granular additive evenly over the filter web, between the tow treatment section and the trumpet guide.

In this invention, the scatter section includes a reference level line connecting the outlet of the tow treatment section and an inlet of the wrapping section, a scattering position located near the outlet of the tow treatment section for scattering the additive, and a flat plate-shaped web guide arranged on the reference level line or above the reference level line and extending from upstream of the scattering position up to the trumpet guide so that the web guide supports a overall lower surface of the filter web and guides the filter web while the filter web is transported.

In this making machine, when the formed filter web is fed from the tow treatment section toward the trumpet guide of the forming section, the filter web is supported on the web guide and thereby prevented from bending downward and kept flat. Thus, the scatter section can scatter the granular additive evenly over the filter web.

Then, as the filter web travels toward the trumpet guide, the filter web is gathered up gradually. This gathering is performed while the filter web is supported on the web guide. The filter web, therefore, forms a large number of relatively small longitudinal creases, regularly and stably.

Further, when the filter web is transported toward the trumpet guide, the web guide suppresses the vertical oscillation of the filter web.

The longitudinal creases and the suppression of vertical oscillation prevent the granular additive scattered over the filter web from moving, so that the even distribution of the granular additive is maintained. When the gathered-up filter web is formed into a rod-shaped material by passing through the trumpet guide and then a filter rod is formed from this rod-shaped material, therefore, the filter rod shows an even distribution of the granular additive in the cross section thereof.

When the granular additive is activated carbon grains, the activated carbon grains in a functional half-tip obtained from the filter rod, which is called a charcoal half-tip, are well exposed to mainstream smoke of a filter cigarette, so that the activated carbon grains can effectively absorb substances contained in the mainstream smoke.

Since the activated carbon grains are not unevenly distributed in the charcoal filter half-tip, it is possible to further increase the amount of the activated carbon grains to be added to the charcoal filter half-tip. In this case, a charcoal half-tip having high absorption performance is obtained.

In order to obtain charcoal filter half-tips from the filter rod, a plurality of cutting process for the half-tips is required. When the granular additive is distributed evenly in the filter rod, the amount of the granular additive falling off a cut face is much reduced in each performance of cutting.

Further, when the rod-shaped material is wrapped in the paper web, the amount of the granular additive sandwiched between the side edges of the paper web decreases, so that the wrapping process of the paper web around the rod-shaped material can be stably performed. Hence, the shutdown of the making machine caused by defective wrapping of the paper web is prevented, and productivity in making the filter rods improves.

Further, when an incidence of the granular additive falling decreases, the possibility that the fallen granular additive causes adverse effect on the forming of dual filter tips and the making of filter cigarettes.

It is desirable that the reference level line extends horizontally and the web guide is located within a region between the reference level line and an upper limit line above the reference level line by 10 mm.

The web guide located in this region does not exert a great resistance to the filter web during the travelling thereof, and ensures stable transport of the filter web.

Other advantages of this invention will become apparent from the best mode of carrying out the invention described referring to the accompanying drawings. It is to be noted that the best of carrying out the invention is not intended to limit the scope of the invention at all.

BEST MODE OF CARRYING OUT THE INVENTION

Figure 1:
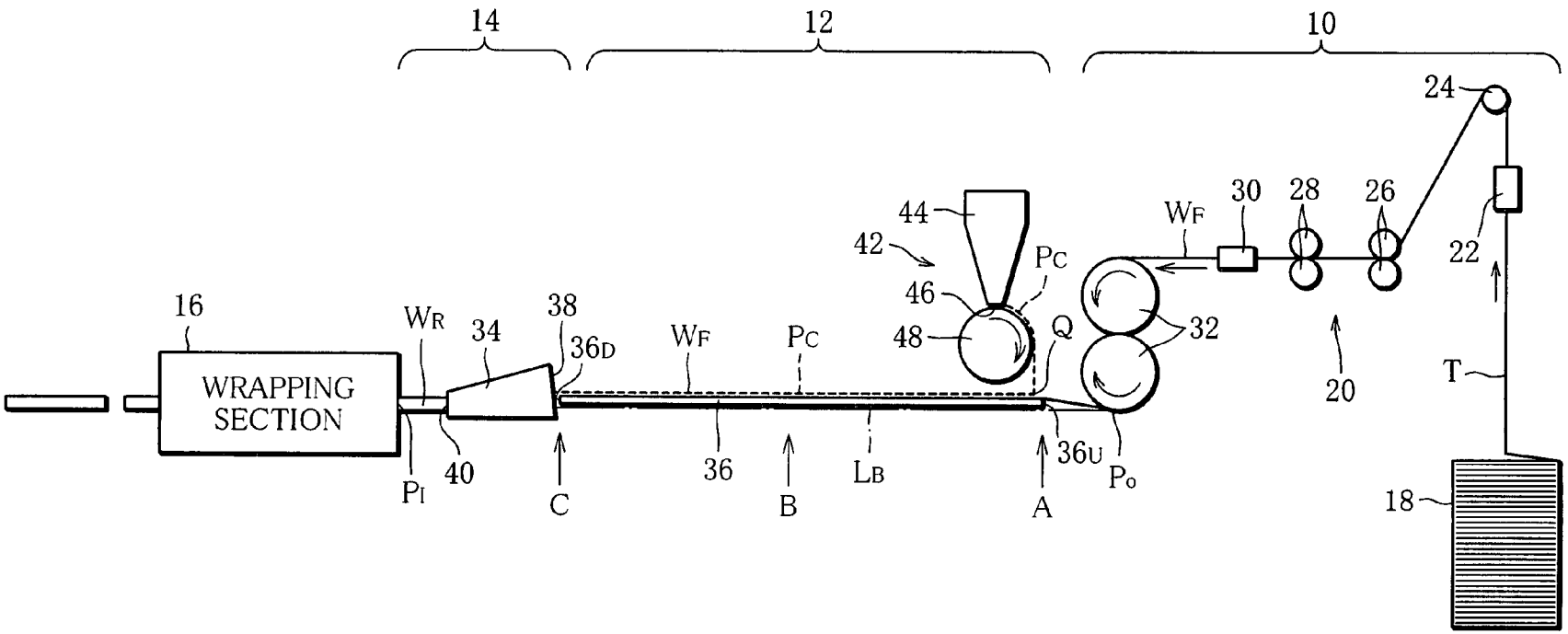
FIG. 1 is a diagram schematically showing a filter rod making machine in one embodiment.

As shown in FIG. 1, a filter rod making machine comprises, as major sections, a tow treatment section 10, an additive scatter section 12, a forming section 14 and a wrapping section 16.

The tow treatment section 10 includes a bale 18 which for example contains cellulose-acetate-fiber filter material or tow T. From the bale 18 extends a tow path 20. Along the tow path 20, there are arranged, from the bale 18 side, a primary banding jet 22, a guide roller 24, a pair of pretension rollers 26, a pair of blooming rollers 28, a secondary banding jet 30 and a pair of feed rollers 32 in this order. The feed rollers 32 are located at the terminal end of the tow path 20.

When the tow T passes through the primary banding jet 22, the primary banding jet 22 sends out compressed air toward the tow T, from the bale 18 side. The compressed air jetted out loosens the tow T and stretches the crimp of the tow T to a moderate degree.

When the tow T reaches the guide roller 24, the guide roller 24 directs the tow T to the paired pretension rollers 26, and the tow T passes through between the paired pretension rollers 26. When the tow passes through, the pretension rollers 26 press the loosened tow T, apply a predetermined tensile force to the tow T in cooperation with the paired blooming rollers 28 and thereby stretch the crimp of the tow T further.

Then, when the tow T passes through between the paired blooming rollers 28, the blooming rollers 28 divide the loosened tow T into a plurality of bundles, and feed the bundles to the secondary banding jet 30.

When the bundles of tow T passes through the secondary banding jet 30, the secondary banding jet 20 sends out compressed air toward the bundles. The compressed air loosens the bundles. As a result, the bundles spread across the width of the tow path 20 and form a flat filter web $W_F$. Then, the filter web $W_F$ passes through between the paired feed rollers 32 and is fed to the scatter section 12 from the feed rollers 32.

The scatter section 12 has a transport path. The transport path extends from the feed rollers 32 to a trumpet guide 34 of the forming section 14. A flat plate-shaped web guide 36 provides the transport path and has a length of 30 to 50 cm. The upper surface of the web guide 36 has an area enough to bear the overall lower surface of the filter web $W_F$ from the feed rollers 32 to the trumpet guide 34, and guides the filter web $W_F$ when the web is transported.

Specifically, in FIG. 1, $L_B$ (chain line) denotes a horizontal reference level line connecting an outlet position $P_0$ of the feed rollers 32 and an inlet position $P_I$ of the wrapping section 16. The reference level line $L_B$ passes through a central part of a circular inlet 38 of the trumpet guide 34 and through the lowermost edge of a circular outlet 40 of the trumpet guide 34.

The web guide 36 is located on the reference level line $L_B$ or slightly above the reference level line $L_B$. More specifically, as viewed in the vertical direction, the web guide 36 is located within a region between the reference level line $L_B$ and the uppermost edge of the inlet 38 of the trumpet guide 34. It is desirable that this region should be defined by the reference level line $L_B$ and an upper limit line that extends 10 mm above the reference level line $L_B$.

In this case, unless no gap is produced between the web guide 36 and the filter web $W_F$, the web guide 36 may be located parallel to or at an angle to the reference level line $L_B$. It is to be noted that the transverse cross-section of the web guide 36 is parallel to the horizontal plane at any position in the transport path.

In order to allow the web guide 36 to be located in the above-mentioned manner, the upstream end $\mathbf{36}_U$ and the downstream end $\mathbf{36}_D$ of the web guide 36 are each supported by means of an adjusting bracket. The levels or heights of the upstream end $\mathbf{36}_U$ and the downstream end $\mathbf{36}_D$ can be adjusted independently.

When the filter web $W_F$ is transported from the feed rollers 32 toward the trumpet guide 34, the web guide 36 simply supports the filter web $W_F$ from beneath, or slightly pushes up the filter web $W_F$ from beneath. It is to be noted that the web guide 36 pushes up the filter web $W_F$ only slightly, and does not exert a great resistance (load) to the filter web $W_F$ while the web is travelling.

As clear from FIG. 1, the upstream end $\mathbf{36}_U$ of the web guide 36 is located at a predetermined distance from the paired feed rollers 32, and the downstream end $\mathbf{36}_D$ of the web guide 36 is located near the inlet 38 of the trumpet guide 34.

Above the upstream end $\mathbf{36}_U$ of the web guide 36 is arranged a device 42 for scattering a granular additive, for example activated carbon grains $P_C$ evenly over the filter web $W_F$. The scattering device 42 includes a hopper 44 for storing the activated carbon grains $P_C$. The hopper 4 has an outlet 46 at the bottom thereof. The outlet 46 is in the form of a slit open downward and extends across the width of the filter web $W_F$. The length of the outlet 46 is equal to or slightly less than the width of the filter web $W_F$ formed in the above-described tow treatment section 10.

Directly below the outlet 46 of the hopper 44 is arranged a scattering roller 48. The scattering roller 48 can rotate in the direction of an arrow shown in FIG. 1. The axis of the scattering roller 48 extends along the length of the outlet 46, and the scattering roller 48 can receive the activated carbon grains $P_C$ discharged through the outlet 46, on the circumferential surface thereof. Specifically, the axial length of the scattering roller 48 is greater than the length of the outlet 46 and than the width of the filter web $W_F$. When the scattering roller 48 is not rotating but stopped, the scattering roller 48 therefore prevents the activated carbon grains $P_C$ from being discharged through the outlet 46.

However, between the circumferential surface of the scattering roller 48 and the outlet 46 is kept a slight gap that allows the activated carbon grains $P_C$ to pass through. The gap is uniform along the axial length of the scattering roller 48. Thus, when the scattering roller 48 is rotated, the activated carbon grains $P_C$ on the scattering roller 48 fall off the diffusion roller 48 onto the filter web $W_F$ and is evenly distributed over the filter web $W_F$.

The position on which the grains $P_C$ fall, which will be referred to as the scattering position Q, is located slightly downstream of the upstream end $\mathbf{36}_U$ of the web guide 36. The distance between the scattering roller 48 and the filter web $W_F$ is short, the distance that the grains $P_C$ fall is no more than about the same as the radius of the scattering roller 48. Therefore, the activated carbon grains $P_C$ do not bounce against the filter web $W_F$, and even distribution of the gains $P_C$ is ensured.

The filter web $W_F$ with the activated carbon grains $P_C$ is transported to the trumpet guide 34 while being guided by the web guide 36, and then passes through the trumpet guide 34. While passing through, the filter web $W_F$ is gathered up by the trumpet guide 34 to form a rod-like shape, namely formed into a rod-shaped material $W_R$. Thus, as indicated by two-dot chain lines in FIG. 2, as the filter web $W_F$ is transported from the feed rollers 32 to the trumpet guide 34, the width of the filter web $W_F$ decreases gradually.

Figure 2:
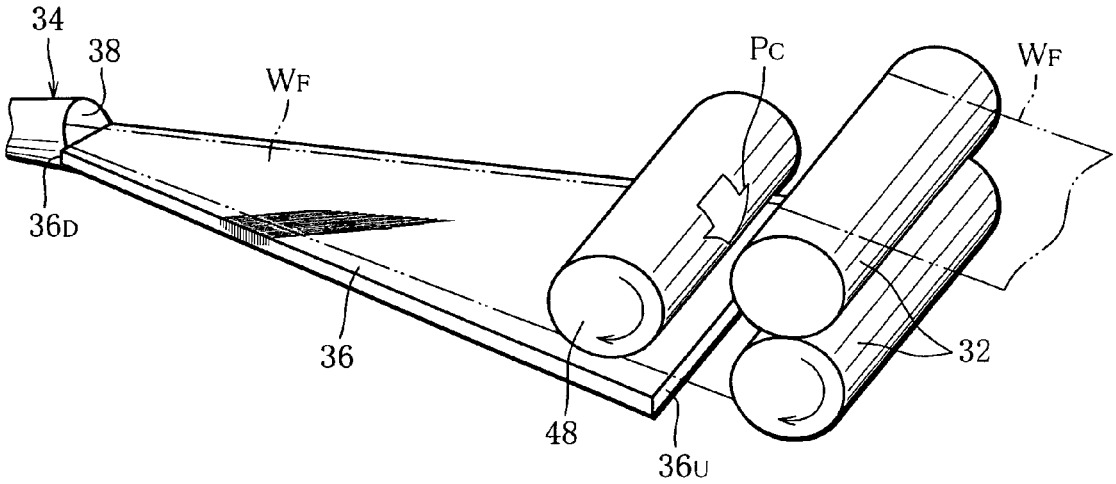
FIG. 2 is a perspective view showing a web guide of the making machine of FIG. 1.

In this embodiment, as clear from FIG. 2, also the width of the web guide 36 is gradually decreased from the feed rollers 32 to the trumpet guide 34, according to the decrease in the width of the filter web $W_F$. Thus, the web guide 36 has a trapezoidal shape tapering toward the trumpet guide 34. It is to be noted that the width of the web guide 36 is greater than the width of the filter web $W_F$ at any position in the transport path so that the web guide can bear and guide the filter web $W_F$ assuredly.

The web guide 36 does not need to be a trapezoidal shape. It can be a rectangular shape. In this case, the width of the web guide 36 is constant along the transport path.

Figure 3:
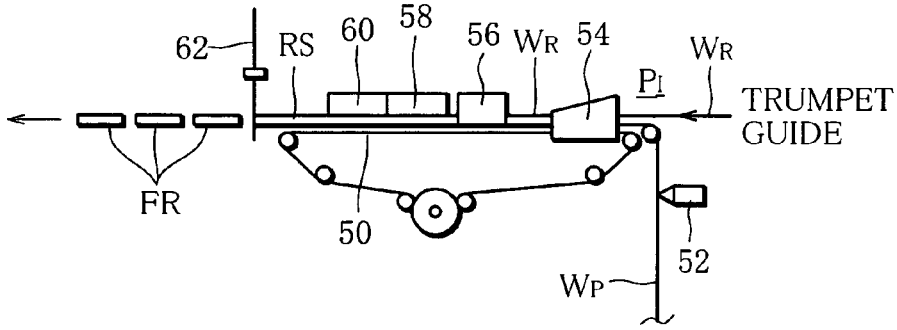
FIG. 3 is a diagram showing a wrapping section of the making machine of FIG. 1 more in detail.

The trumpet guide 34 feeds the rod-shaped material $W_R$ to the wrapping section 16. FIG. 3 shows the details of the wrapping section 16.

The wrapping section 16 will be described only briefly, since the wrapping section 16 is similar in structure to a wrapping section for making cigarette rods.

The wrapping section 16 has an endless garniture tape 50. The garniture tape 50 travels on a horizontal forming bed (not shown) in the direction in which the rod-shape material $W_R$ is transported.

At the inlet position $P_I$ of the wrapping section 16, a paper web $W_P$ is fed onto the garniture tape 50. The paper web $W_P$ is fed from a paper roll to the garniture tape 50 via a reservoir and a spray gun 52. The spray gun 52 applies an adhesive called rail glue to the center of the width of the paper web $W_P$. In FIG. 3, the paper roll and the reservoir are omitted.

At the inlet position $P_I$, the rod-shaped material $W_R$ fed from the trumpet guide 34 is laid on the paper web $W_P$, where the rod-shaped material $W_R$ and the paper web $W_P$ are stuck together by the rail glue.

Then, the rod-shaped material $W_R$ and the paper web $W_P$ travel on the forming bed with the garniture tape 50, and pass through a tongue 54, a wrapping former 56, a heater 58 and a cooler 60 in this order.

The tongue 54 cooperates with the forming bed to further compress the rod-shaped material $W_R$, through the garniture tape 50 and the paper web $W_P$. In this step, the rod-shaped material $W_R$ is formed to a circular cross-section, while the paper web $W_P$ and the garniture tape 50 are bent to a U-shaped cross-section. At this time, the lower half of the rod-shaped material $W_R$ is covered with the paper web $W_P$.

Then, while the rod-shaped material $W_R$ is passing through the wrapping former 56, one of the two side-edge parts of the paper web $W_P$, which will be referred to as a first side-edge part, is laid on one side of the upper half of the rod-shaped material $W_R$ through the garniture tape 40. At the same time, a glue spray (not shown) of the wrapping former 56 apples seam glue on the other side-edge part of the paper web $W_P$, which will be referred to as a second side-edge part. Then, the second side-edge part of the paper web $W_P$ is laid on the rod-shaped material $W_R$ through the garniture tape 50 in like manner, so that the second side-edge part overlaps the first side-edge part with the seam glue therebetween. At this time, the two side-edge parts of the paper web $W_P$ are stuck together by the seam glue, and the rod-shaped material $W_R$ is completely wrapped in the paper web $W_P$ and forms a charcoal filter rod continuum RS.

While the charcoal filter rod continuum RS is passing through the heater 58 and the cooler 60, the seam glue is dried and then cooled.

In this embodiment, the wrapping section 16 has a rotary knife 62 downstream of the forming bed or the garniture tape 50. The rotary knife 62 cuts the charcoal filter rod continuum RS into individual charcoal filter rods FR.

Next, the function of the web guide 36 will be described referring to FIG. 4.

Figure 4:
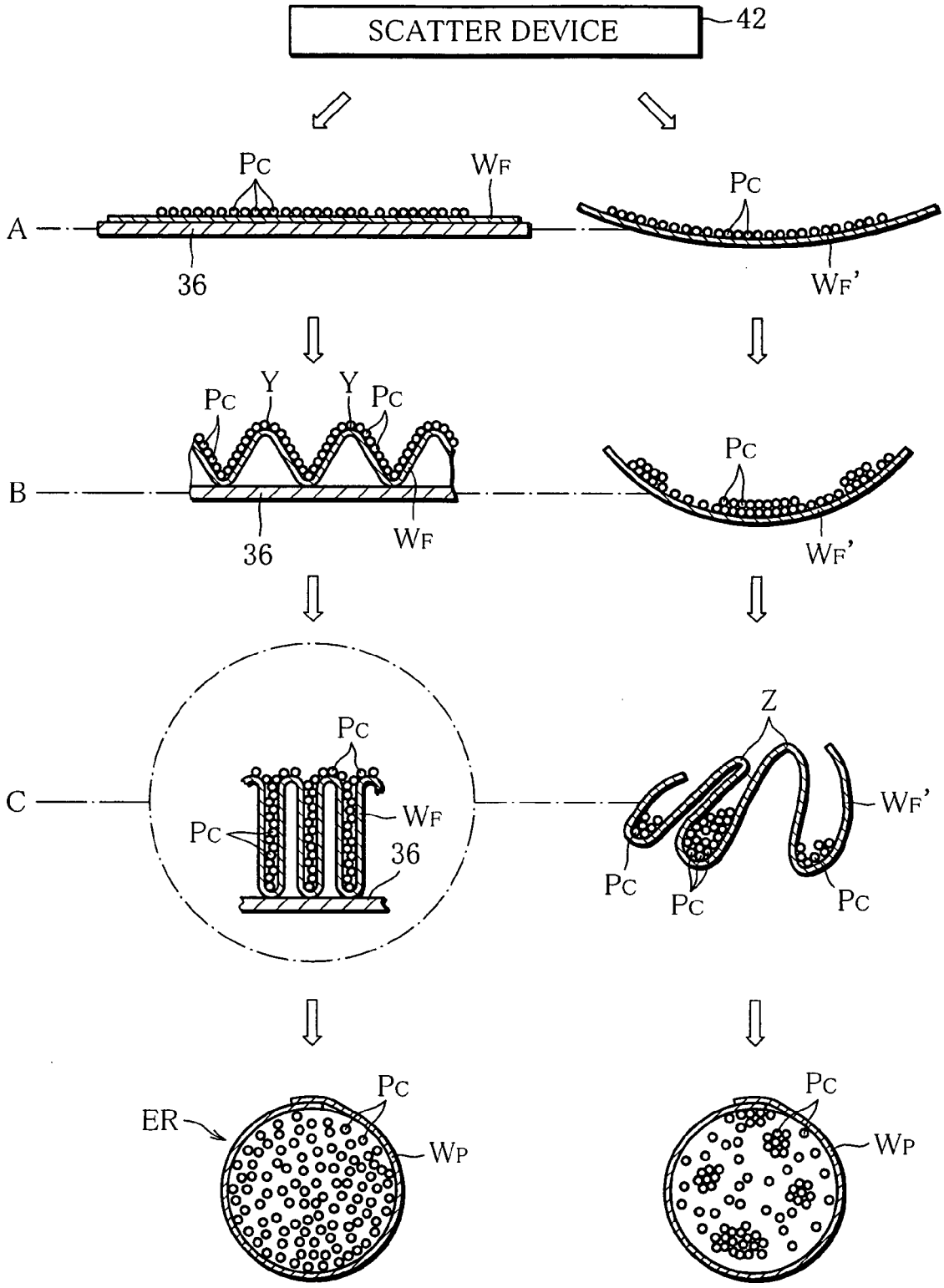
FIG. 4 is a diagram for explaining the function of the web guide of FIG. 3, in comparison with a case in which the web guide is not provided.

In FIG. 4, the left-hand flow shows, step by step, how the filter web $W_F$ is transported, being guided by the web guide 36. The right-hand flow shows, step by step, how the filter web $W_{F'}$ is transported when the web guide 36 is not provided. In FIG. 4, reference signs A, B and C refer to those positions in transport of the filter webs $W_F$ and $W_{F'}$ which are indicated by reference signs A, B and C in FIG. 1, respectively.

Position A

When activated carbon grains $P_C$ are scattered over the filter web $W_F$ from the device 42, the filter web $W_F$ in the left-hand flow is supported by the web guide 36. Therefore, the filter web $W_F$ does not bend downward due to the weight of the filter web $W_F$ and the weight of the grains $P_C$, and the filter web $W_F$ is kept flat.

Meanwhile, since the filter web $W_{F'}$ in the right-hand flow is free, the filter web $W_{F'}$ bends downward due to the weight of the filter web $W_{F'}$ and the weight of the grains $P_C$.

Position B

The filter web $W_F$ is gathered up gradually while the filter web $W_F$ is transported toward the trumpet guide 34. At even this time, the filter web $W_F$ in the left-hand flow is supported by the web guide 36. The web guide 36 also holds down vertical oscillation of the filter web $W_F$ caused by the travelling of the filter web $W_F$.

Thus, with the help of the web guide 36, the filter web $W_F$ is stably gathered up in the width direction thereof, and a large number of relatively small longitudinal creases Y of the filter web $W_F$ are formed. These longitudinal creases Y prevent the activated carbon grains $P_C$ on the filter web $W_F$ from moving across the width of the filter web $W_F$. As a result, although the longitudinal creases Y are formed, the even distribution of the grains $P_C$ is maintained as viewed in the width of the filter web $W_F$.

Meanwhile, the filter web $W_{F'}$ in the right-hand flow bends downward largely when the filter web $W_{F'}$ is gathered up toward trumpet guide 34 while traveling. Further, the filter web $W_{F'}$ vertically oscillates with a great amplitude. Thus, the activated carbon grains $P_C$ on the filter web $W_{F'}$ moves toward the bottom of the filter web $W_{F'}$. As a result, the grains $P_C$ are distributed at high density in some parts and at low density in other parts as viewed in the width of the filter web $W_{F'}$. Thus, the even distribution of the grains $P_C$ is lost.

Position C

When the filter web $W_F$ in the left-hand flow enters the trumpet guide 34, the longitudinal creases Y pile up in diametrical directions of the trumpet guide 34. Therefore, the activated carbon grains $P_C$ are mostly held between the longitudinal creases Y and completely prevented from moving.

In contrast, the filter web $W_{F'}$ in the right-hand flow is gathered up rapidly just before entering the trumpet guide 34. Compared with the longitudinal creases Y, a plurality of large longitudinal creases Z are formed irregularly, and the filter web is divided into high density parts of the grains $P_C$ and low density parts of the grain $P_C$ by these longitudinal creases Z.

As a result, the rod-shaped material and the charcoal filter rod FR obtained from the filter web $W_F$ show an even distribution of the activated carbon grains $P_C$ in the transverse cross-section. Meanwhile the charcoal filter rod obtained from the filter web $W_{F'}$ shows an uneven distribution of the grains $P_C$ in the transverse cross-section.

It is to be noted that in FIG. 4, the longitudinal creases Y and Z are shown in an exaggerated manner in order to make the function of the web guide 36 clearer.

Since the activated carbon grains $P_C$ are evenly distributed in the charcoal filter rod FR as mentioned above, also the charcoal half-tip obtained from the charcoal filter rod FR has an even distribution of the grains $P_C$.

When a filter cigarette with a dual filter tip including the charcoal half-tip, is smoked, the grains $P_C$ in the charcoal half-tip can be well exposed to mainstream smoke of the filter cigarette. Thus, the charcoal half-tip improves the absorption performance of the dual filter tip.

In order to obtain the charcoal filter rod FR and then the charcoal half-tip, cutting is performed in a plurality of steps. In any of these steps, the cut face produced by cutting has an even distribution of the activated carbon grains $P_C$. As a result, the amount of the grains $P_C$ falling off the cut face substantially decreases and the possibility that the fallen activated carbon grains $P_C$ cause adverse effects on subsequent steps is low.

Further, under the circumstance that the grains $P_C$ are evenly distributed, a problem such that a large number of the activated carbon grains $P_C$ are caught between the side edges of the paper web $W_P$ when the rod-shaped material is wrapped in the paper web $W_P$ does not happen. Thus, the paper web $W_P$ can be stably wrapped around the rod-shaped material, and defective wrapping of the paper web $W_P$ is prevented. As a result, the incidence of shutdown of the making machine caused by the defective wrapping decreases, and productivity in making the charcoal filter rods FR improves.

Figure 5:
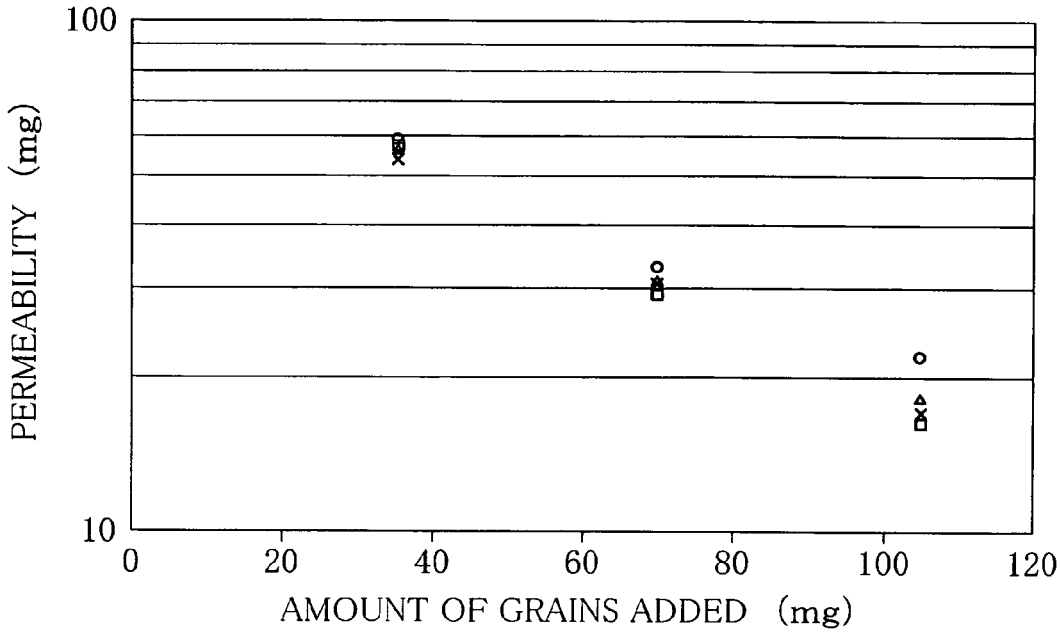
FIG. 5 is a graph showing the absorption performance of a dual filter tip, which depends on the arrangement of the web guide.

FIG. 5 shows the relation between the amount of grains $P_C$ added to the dual filter tip (charcoal half-tip) of the filter cigarette and the permeability to a substance contained in mainstream smoke passing through the duel filter tip, for example benzene (in other words, the benzene absorption performance of the grains $P_C$). The measurement data shown in FIG. 5 was obtained in the following way: Filter cigarettes having various type of dual filter tips which were different in the amount of grains $P_C$ added and filter cigarettes having an ordinary plain filter tip were made by a predetermined number, respectively. In all the filter cigarettes made, the length of the filter tip was the same.

Each filter cigarette was smoked according to the smoking test standardized by the ISO (International Standard Organization), and mainstream smoke passing through the filter tip was collected by means of a Cambridge filter (trademark). The mainstream smoke collected was supplied to an analyzer for gas chromatography, and the amount of benzene contained in the mainstream smoke was measured by the analyzer.

FIG. 5 shows the ratio of the amount of benzene contained in the mainstream smoke obtained from a filter cigarette having a duel filter tip to the amount of benzene contained in the mainstream smoke obtained from a filter cigarette having a plain filter tip, namely the ratio of the permeability to benzene of the former filter cigarette to that of the latter filter cigarette.

Filter cigarettes represented by symbols □, X, Δ and ○ in FIG. 5 have dual filter tips including charcoal half-tips made in different manners. More specifically, charcoal filter rods FR for these charcoal half-tips were made by making machines with the web guide 36 arranged in different positions.

Figure 6:
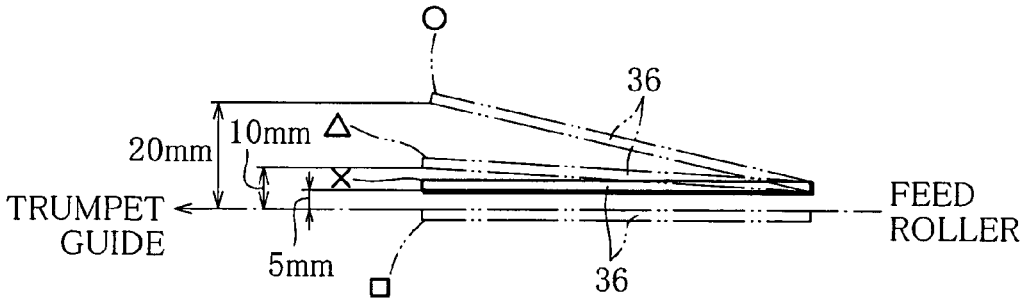
FIG. 6 is a diagram showing various manners of the web guide arrangement.

For the filter cigarette represented by symbol □, the charcoal filter rod FR was made by the making machine with the web guide 36 located on the reference level line $L_B$ as shown in FIG. 6. For the filter cigarette represented by symbol X, the charcoal filter rod FR was made by the making machine with the web guide 36 lifted from the reference level line $L_B$ by 5 mm parallel to the line $L_B$. For the filter cigarette represented by symbol Δ, the charcoal filter rod FR was made by the making machine with the web guide 36 whose downstream end was lifted further by 5 mm from the position of the web guide 36 for the filter cigarette represented by symbol X. In this case, an inclination angle of the web guide 36 is determined by the length thereof and the lift of the downstream end. For the filter cigarette represented by symbol ○, the charcoal filter rod FR was made by the making machine with the web guide 36 whose downstream end was lifted further by 10 mm from the downstream end position of the web guide 36 for the filter cigarette represented by symbol Δ.

As clear from FIG. 5, in the filter cigarettes represented by symbols □, X, and Δ, as the amount of activated carbon grains $P_C$ added increases, the permeability to benzene decreases in similar manners. Meanwhile, compared with the filter cigarettes represented by symbols □, X and Δ, the filter cigarette represented by symbol ○ shows higher permeability to benzene when the amount of activated carbon grains $P_C$ added is increased.

This indicates that in the case of the filter cigarette represented by symbol ○, the downstream end of the web guide 36 is too great a distance above the reference level line $L_B$, so that space is produced between the web guide 36 and the filter web $W_F$. More specifically, such space allows the filter web $W_F$ to bend downward and oscillate vertically and thereby causes the problem that the activated carbon grains $P_C$ moves.

The measurement data also indicates that in the case of the filter cigarettes represented by symbols □, X and Δ, no space is produced between the web guide 36 and the filter web $W_F$, so that the above problem does not happen.

Regarding the arrangement of the web guide 36, it is important to ensure that no space is produced between the filter web $W_F$ and the web guide 36, from the position Q where activated carbon grains $P_C$ are scattered up to the inlet 38 of the trumpet guide 38.

Further, in the case of the filter cigarette represented by symbol ○, as the web guide 36 is steeply inclined, the web guide 36 exerts a great resistance (load) to the filter web $W_F$ when the web is travelling. Thus, it is desirable that the web guide 36 should be located within a region between the reference level line $L_B$ and an upper limit line that extends 10 mm above the reference level line $L_B$. Particularly when the web guide 36 is so arranged that the downstream end thereof is at a higher position than the upstream end thereof, the bending and vertical oscillation of the filter web $W_F$ can be effectively held down without increasing the resistance exerted on the filter web $W_F$ when the web is travelling.

Although the shape, location and position of the trumpet guide 34 vary depending on the type of tow T, etc., the reference level line $L_B$ extending from the feed rollers 32 to the inlet position $P_I$ of the wrapping section 16 is fixed. As already mentioned, therefore, it is desirable to determine the arrangement of the web guide 36 based on the reference level line $L_B$.

Figure 7:
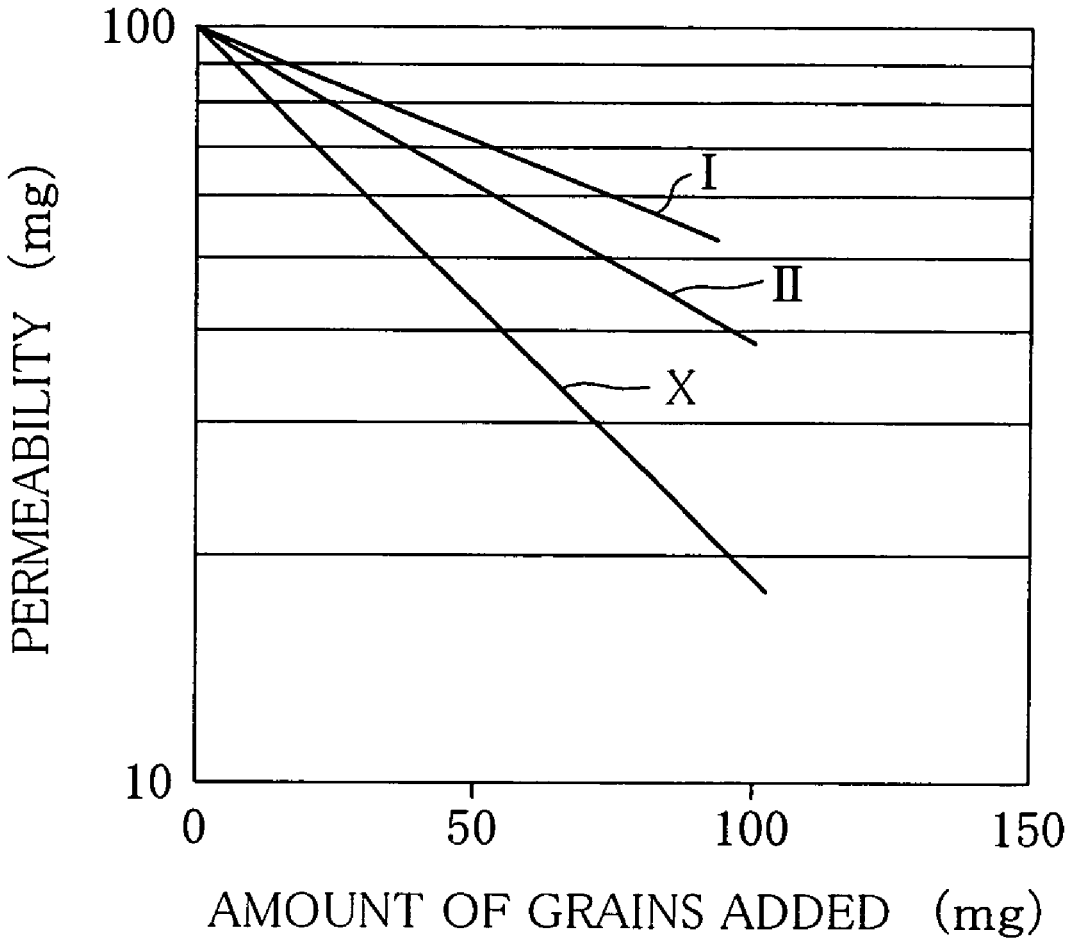
FIG. 7 is graph showing the absorption performance of a dual filter tip obtained by a making machine according to the invention, and of other dual filter tips, for comparison.

FIG. 7 shows the relation between the amount of activated carbon grains $P_C$ added and the permeability to benzene in a manner similar to that in FIG. 5.

In FIG. 7, the filter cigarette denoted by reference sign I has a charcoal half-tip obtained from a charcoal filter rod made by a making machine not provided with any guide for a filter web $W_F$. The filter cigarette denoted by reference sign II has a charcoal half-tip obtained from a charcoal filter rod made by a making machine provided with a coil tunnel as a guide for a filter web $W_F$.

As clear from FIG. 7, the dual filter tip of the filter cigarette according to the present invention, denoted by reference sign X (see FIG. 5), has a lower permeability to benzene, or in other words, a higher benzene absorption performance, compared with the dual filter tips of the filter cigarettes denoted by reference signs I and II.

In FIG. 6, the web guides 36 denoted by reference signs X and Δ each have the upstream end located 10 mm above the reference level line $L_B$. However, the upstream ends of these web guides 36 may be located on the reference level line $L_B$.

The making machine according to the present invention is suitable for making a filter rod containing various granular additives such as silica gel and aroma material in addition to activated carbon grains $P_C$.

The invention claimed is:

1. A filter rod making machine, comprising:

a tow treatment section for forming a flat filter web from fibrous tow, said tow treatment section having an outlet through which the formed filter web is fed;

a forming section for forming the filter web into a rod-shaped material, said forming section including a trumpet guide through which the filter web fed from the tow treatment section is passed so that the filter web is gathered up into the rod-shaped material;

a wrapping section for receiving the rod shaped material from said forming section and wrapping the rod-shaped material in a paper web to form a filter rod continuum, said wrapping section having an inlet for receiving the rod-shaped material from said forming section; and a scatter section arranged between said tow treatment section and the trumpet guide of said forming section for scattering a granular additive evenly over the filter web, wherein said scatter section includes a reference level line connecting the outlet of said tow treatment section and an inlet of said wrapping section, a scattering position located near the outlet of said tow treatment section for scattering the additive, and a flat plate-shaped web guide arranged on the reference level line or above the reference level line and extending from downstream of the scattering position up to the trumpet guide, and said web guide bears the overall lower surface of the filter web and guides the filter web while the filter web is transported.

2. The making machine according to claim 1, wherein the reference level line extends horizontally, and said web guide is arranged within a region between the reference level line and an upper limit line by 10 mm above the reference level line.

3. The making machine according to claim 2, wherein said web guide is parallel to the reference level line.

4. The making machine according to claim 3, wherein said web guide is arranged on the reference level line.

5. The making machine according to claim 3, wherein said web guide is arranged above and apart from the reference level line.

6. The making machine according to claim 2, wherein said web guide is tilted to ascend toward the trumpet guide.

7. The making machine according to claim 6, wherein said web guide has an upstream end located on or above the reference level line.

8. The making machine according to claim 1, wherein said web guide has a width gradually decreasing toward the trumpet guide.

* * * * *